US005119701A

United States Patent [19]

Wei

[11] Patent Number: 5,119,701

[45] Date of Patent: Jun. 9, 1992

[54] BASE SEAT OF A DUAL-DIRECTIONAL RATCHET WRENCH

[76] Inventor: Hung-Yin Wei, No. 21 Lane 225 Taiping Road, Taiping Hsiang, Taichung Hsieh, Taiwan

[21] Appl. No.: 641,646

[22] Filed: Jan. 15, 1991

[51] Int. Cl.[5] ..... B25B 13/46

[52] U.S. Cl. ..... 81/63; 81/63.2

[58] Field of Search ..... 81/63, 63.2

[56] References Cited

U.S. PATENT DOCUMENTS 4,703,676 11/1987 Mayer ..... 81/63
4,770,072 9/1988 Neuhaus ..... 81/63.2 X
4,819,521 4/1989 Wang ..... 81/63
4,862,775 9/1989 Chow ..... 81/63.2
4,873,899 10/1989 Mazurek ..... 81/63

*Primary Examiner*—James G. Smith
*Attorney, Agent, or Firm*—Bacon & Thomas

[57] ABSTRACT

The base seat of a dual-directional ratchet wrench has a protective rim enclosing the perimeter of the sandwich parts. The rectangular windows are arranged on the protective rim at the positions corresponding to those of two lugs of the set regulator so as to ensure that the sandwich parts are embraced completely after the disposition of the set regulator in the base seat. The inner side of the protective rim is a smooth surface devoid of the flange so that modifications of molding apparatus for manufacture of sandwich parts, set regulators, etc. are not required.

3 Claims, 3 Drawing Sheets

BASE SEAT OF A DUAL-DIRECTIONAL RATCHET WRENCH

BACKGROUND OF THE INVENTION

This invention relates to a dual-directionl ratchet wrench, which has a base seat with rectangular windows allowing the set regulator to jut out.

There are one-directional ratchet wrench and dual-directional ratchet wrench available in the market place today. A conventional ratchet wrench, as shown in FIG. 1, comprises two sandwich parts 11, one base seat 12, a ratchet wheel 13 and a fastening block 14 sandwiched between the end portion of the sandwich part 11. The conventinal ratchet wrench mentioned above is, of course, a convenient tool used for holding or turning nuts, bolts, pipes, etc. However, an improper washing press operation or a poor polishing job done during the manufacturing process can bring about the sandwich parts having sharp edges. As a result, the sandwich parts 11 located over and under the base seat 12 are prone to cause an uncomfortable sensation to a user's hand holding the wrench.

Therefore, as a remedy for the defect mentioned above, an improved one-directional ratchet wrench, as shown in FIG. 2, was introduced. The extended end portion of the wall of the base seat 12 forms a protective rim 15, which embraces the sandwich part 11 in such a manner that the edge of the sandwich part 11 is not exposed so as to ensure the comfort of a user's hand holding the wrench. However, the inner side of the protective rim 15 has a flange 16 disposed thereon, which in turn is responsible for the necessity of expanding the outer rim of the sandwich part and of reducing the size of the fastening block 14. As a result, the changes in molding apparatus are called for accordingly, resulting in an increase in the cost of production of the wrench. Furthermore, the over-all size of the one-directional ratchet wrench as such would have be enlarged cumbersomely.

The solution to the foregoing problems of the one-directional ratchet wrench is unfortunately not applicable to the duel-directional ratchet wrench, which has a set regulator to be contended with. In any event, the dual-directional ratchet wrench of the conventional type is not well received by the public at large becuse of its appearance of poor quality.

SUMMARY OF THE INVENTION

The primary objective of the invention is to provide a dual-directional ratchet wrench with a base seat, which has a protective rim enclosing the perimeter of the sandwich parts. The rectangualr windows are arranged on the protective rim as the positions corresponding to those of two lugs of the set regulator so as to ensure that the sandwich parts are embraced completely after the disposition of the set regulator and that user's hand holding the wrench does not experience an uncomfortable sensation.

It is another objective of the invention to provide a dual-directional ratchet wrench with a base seat, which has a protective rim whose inner side is a smooth surface devoid of the flange so as to ensure that changes in the sizes of sandwich parts and set regulators are not called for and that both cumbersome appearance of the wrench and an increase in the cost of production of the wrench are averted.

It is still another objective of the invention to provide a dual-directional ratchet wrench with a base seat, which has a protective rim enclosing the perimeter of the sndwich part in order to give an appearance of attractiveness in favor of the marketability of the wrench.

BRIEF DESCRTIPTION OF THE DRAWINGS

DETAILED DESCRIPTION OF THE PRFERRED EMBODIMENT

Figure 1:
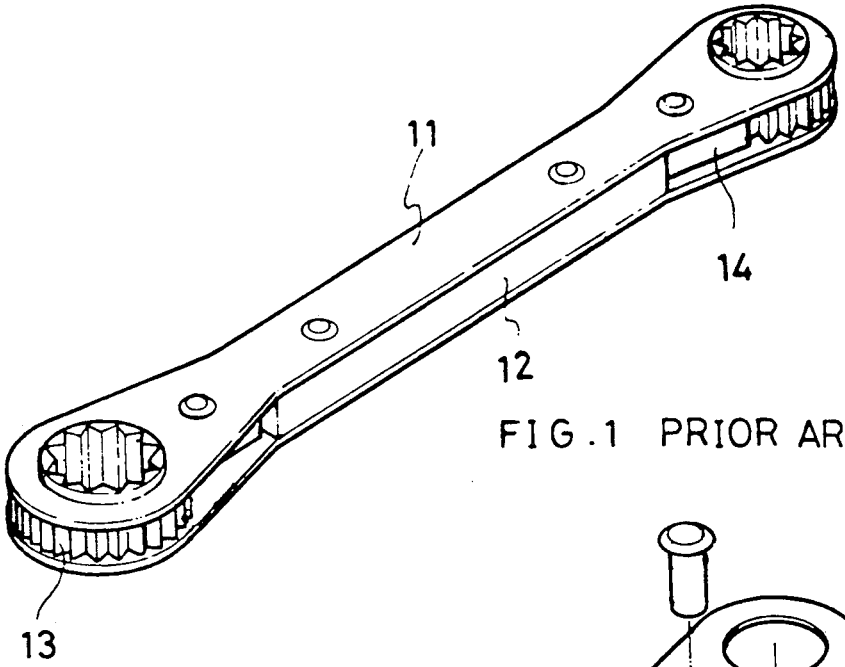
FIG. 1 PRIOR ART
FIG. 1 shows an external view of one-directional ratchet wrench according to the prior art.
Figure 2:
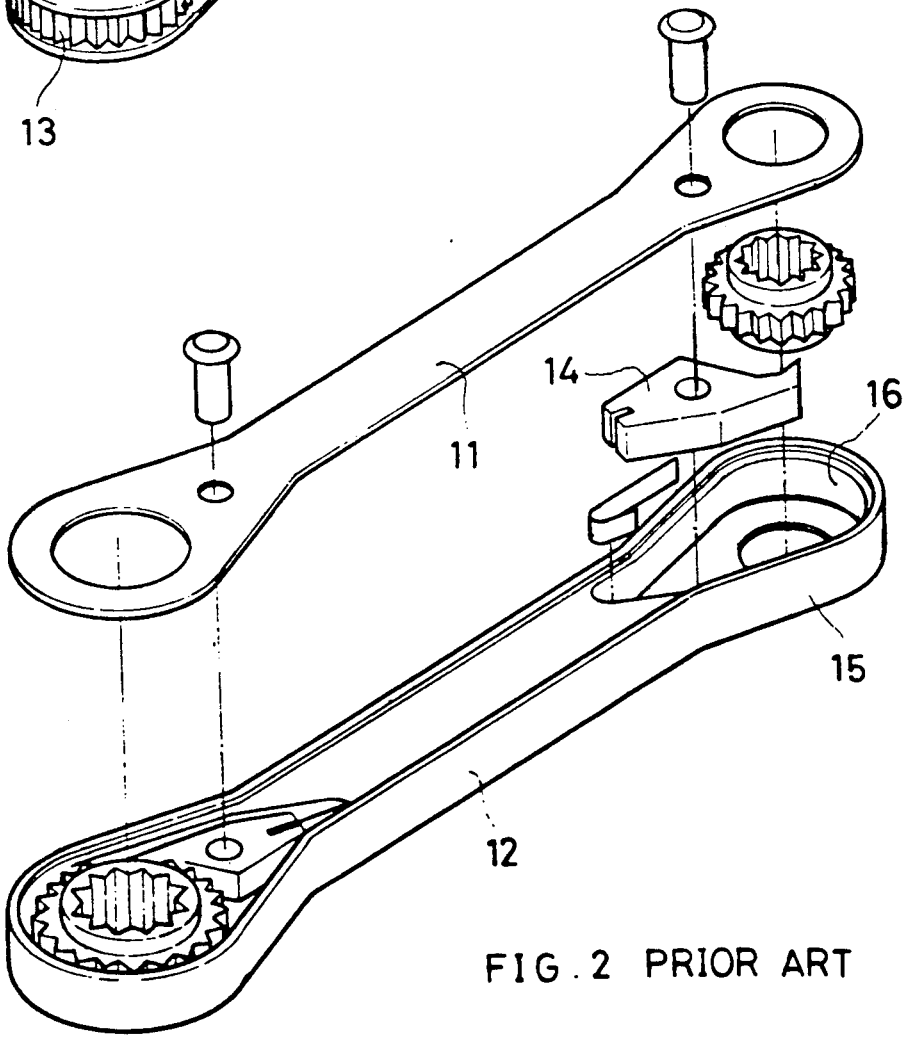
FIG. 2 PRIOR ART
FIG. 2 shows an exploded view of an improved one-directional ratchet wrench according to the prior art.
Figure 3:
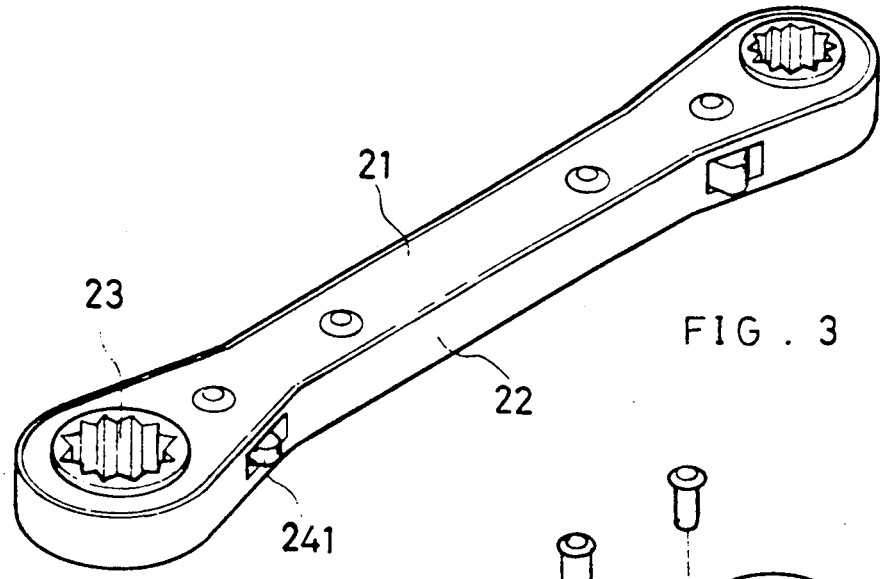
FIG. 3 shows an external view of the invention.
Figure 4:
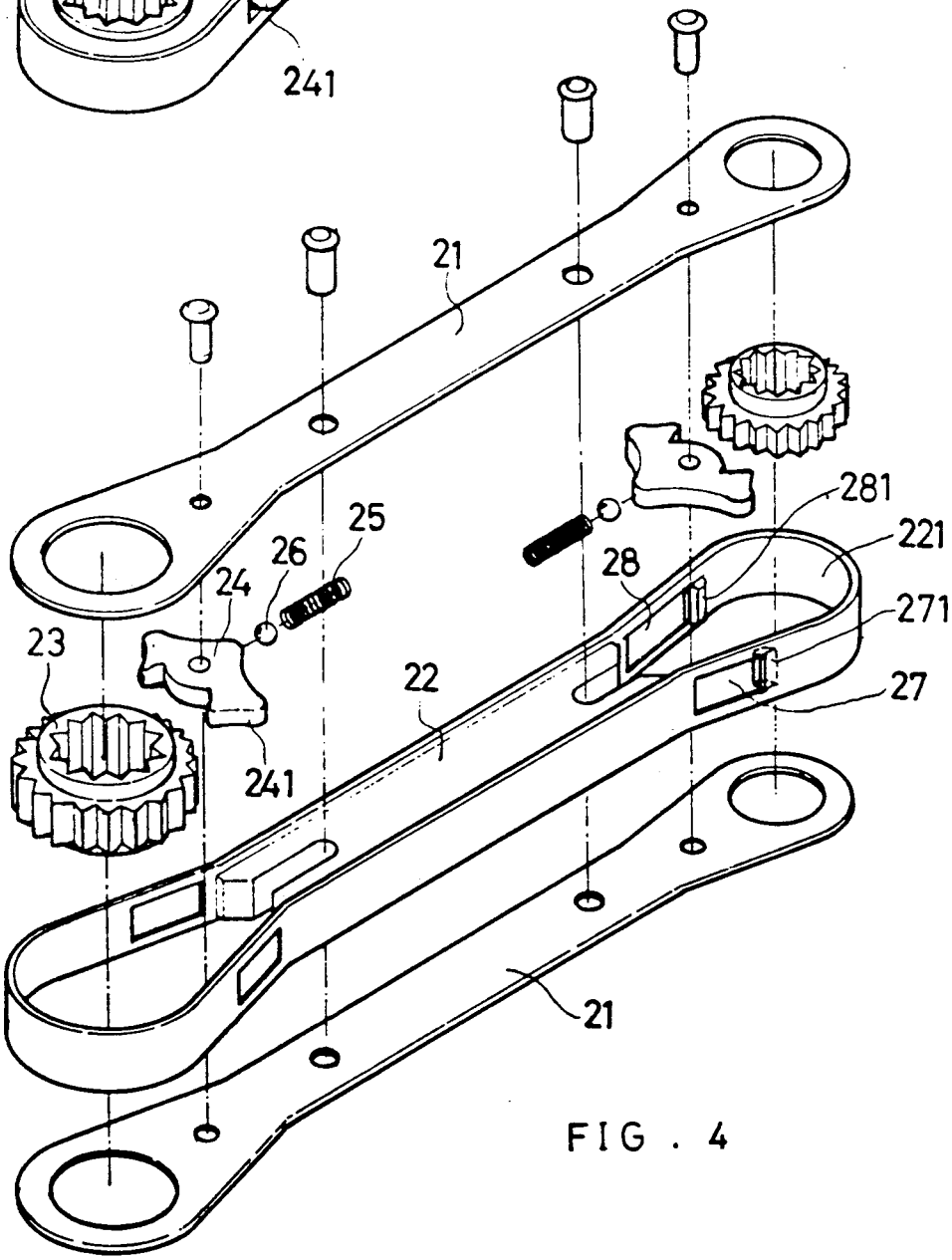
FIG. 4 shows an exploded view of dual-directional ratchet wrench according to this invention.
Figure 5:
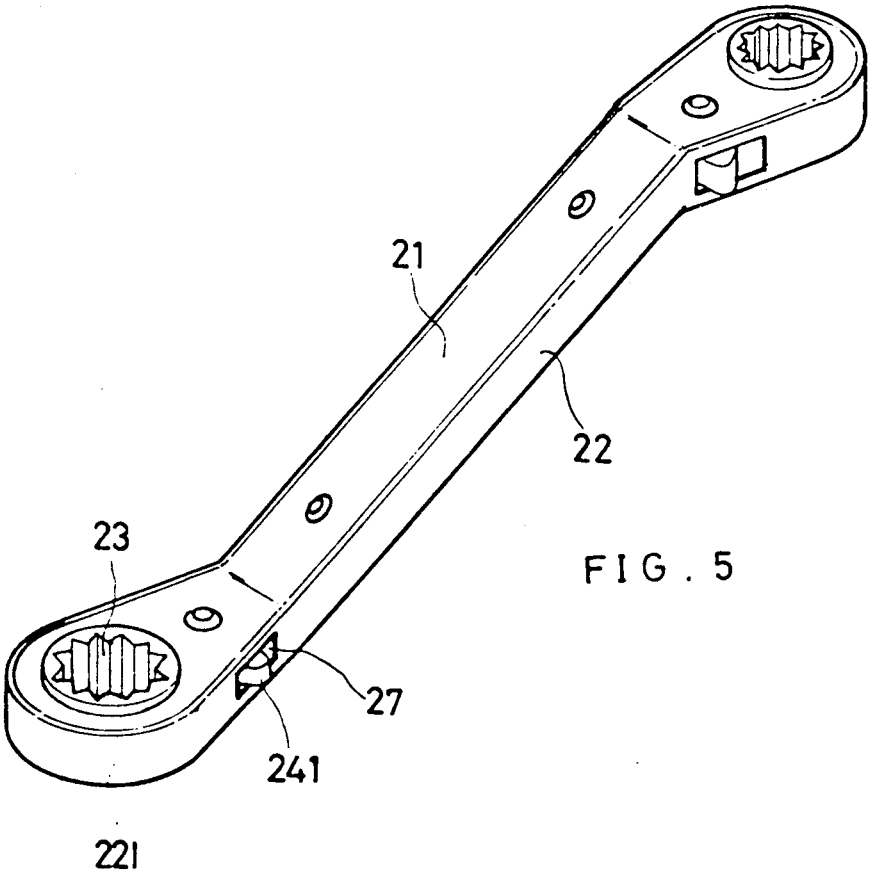
FIG. 5 shows an external view of another enbodiment of the invention.

Referring to FIGS. 3 and 4, a dual-directional ratchet wrench embodied in this invention is shown comprising two sandwich parts 21, a base seat 22, two ratchet wheels 23, two set regulators 24, two coiled springs 25 and two steel beads 26. With the exception of the base seat 22, the rest of the structural components mentioned above will not be recapitulated, because their structures and functions remain the same as those of a conventional ratchet wrench.

Now referring to FIG. 4 showing features of the embodiment of this invention, there is a closed protective rim 221 formed at each extended end portion of the base 22. The rectangular windows 27 and 28 are arranged on the protective rim 221 at the positions corresponding to those of two lugs 241 of the set regulator 24. The width of rectangular windows 27 and 28 is slightly greater than the thickness of the set regulator 24 to facilitate the extrusion of the lug 241, which can be thus set. The height of the narrow portions of the protective rim located just over and under the rectangular windows 27 and 28 must be either greater or equal to the thickness of the sandwich parts 21 so as to ensure that the sandwich parts 21 are embraced completely after the dispositon of the set regulator 24. The inner side of the protective rim 221 located at the extreme end of the base seat 22 is a smooth surface devoid of any flange.

The embodiment of this invention is further characterized in that the set regulator 24 can be lodged via the performed rectangular windows 27 and 28 located on the protective rim 221 so that the lugs 241 are properly set up in the base seat 22.

The inner surface of the protective rim of the base seat according to this invention is smooth and devoid of any flange. As a result, the changes in sizes and dimensions of sandwich parts, set regulators and other elements are not called for. Therefore, the structural components of any dual-directional ratchet wrench of a coventional type are fully compatible with this invention without costly modifications.

In addition, the perimeter of the sandwich part is so totally enclosed by the closed protective rim of the base seat that the wrench is neatly and attractively packaged so as to enhance its marketability.

Furthermore, located at the inner sides of the front ends of the rectangualr windows 27 and 28 are protruded points 271 and 281, which serve to uphold the sandwich parts 21 and can be used as gates during extrusion molding.

I claim:

1. A dual directional wrench comprising:

a) a base seat having two opposite ends;

b) a pair of planar-shaped sandwich parts secured to opposite sides of the base seat;

c) a first closed protective rim formed at one end of the base seat, the first rim including a smooth uninterrupted inner wall surface extending between opposite terminal outer edges of the first rim, and a pair of opposed rectangular windows formed in the first rim, each window being partially defined by upper and lower narrow portions, with each narrow portion having a width that is equal to or greater than the thickness of each sandwich part so that the perimenter of each sandwich part is enclosed by the first rim; and d) a ratchet wheel and a set regulator disposed within the first rim, and the set regulator including two lugs extending outwardly through the windows.

2. The dual directional wrench of claim 1 further including:

a) a second closed protective rim formed at the other end of the base seat, the second rim inculding a smooth uninterrupted inner wall surface extending between opposite terminal outer edges of the second rim, and a pair of opposed rectangular windows formed in the second rim, each window being partially defined by upper and lower narrow portion having a width the is equal to or greater than the thickness of each sandwich part so that the perimeter of each sandwich part is enclosed by the second rim; and b) a ratchet wheel and a set regulator disposed within the second rim, and the set regulator including two lugs extnding through the windows.

3. The dual direction wrench of claim 1 further including a point member protruding inwardly at a foward end of each window for supporting the sandwich parts and defining gates for extrusion molding of the base seat.

* * * * *